US005685733A

United States Patent [19]

Janczak

[11] Patent Number: 5,685,733

[45] Date of Patent: Nov. 11, 1997

[54] INSULATION DISPLACEMENT CONTACT ELEMENT

[75] Inventor: Andrzej Janczak, Berlin, Germany

[73] Assignee: Krone Aktiengesellschaft, Berlin-Zehlendorf, Germany

[21] Appl. No.: 378,190

[22] Filed: Jan. 25, 1995

[30] Foreign Application Priority Data

Jan. 31, 1994 [DE] Germany ..... 44 03 278.1

[51] Int. Cl.[6] ..... H01R 4/24

[52] U.S. Cl. ..... 439/395

[58] Field of Search ..... 439/395–404, 439/417–419

[56] References Cited

U.S. PATENT DOCUMENTS

| | | | |
|---|---|---|---|
| 3,950,062 | 4/1976 | Reavis, Jr. . | |
| 4,223,971 | 9/1980 | Dola et al. . | |
| 4,230,391 | 10/1980 | Keglewitsch | 439/395 |
| 4,258,973 | 3/1981 | Reynolds et al. | 439/395 |
| 4,861,278 | 8/1989 | McBride et al. | 439/395 |
| 4,913,659 | 4/1990 | Doyle | 439/395 |
| 5,088,933 | 2/1992 | Ribbeck | 439/395 |
| 5,290,176 | 3/1994 | Soes et al. | 439/398 |

FOREIGN PATENT DOCUMENTS

| | | |
|---|---|---|
| 0 043 437 | 1/1982 | European Pat. Off. . |
| 2 463 523 | 2/1981 | France . |
| 31 16 731 C2 | 3/1985 | Germany . |
| 3522112 A1 | 1/1987 | Germany . |
| 29 39 382 C2 | 3/1987 | Germany . |
| 32 20 844 C2 | 8/1990 | Germany . |
| 9006417 U | 9/1990 | Germany . |

*Primary Examiner*—J. J. Swann
*Attorney, Agent, or Firm*—McGlew and Tuttle

[57] ABSTRACT

An insulation displacement contact element of a blade-type, resilient contact material having a contact slot provided with an insertion opening. The outer edges generally parallel to the contact slot are provided in an area of a wire contact zone of the contact slot with cutouts.

20 Claims, 2 Drawing Sheets

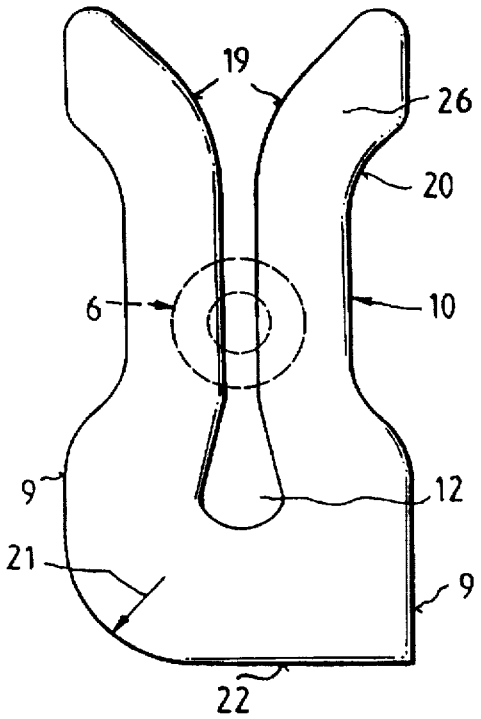
FIG.5
FIG.6
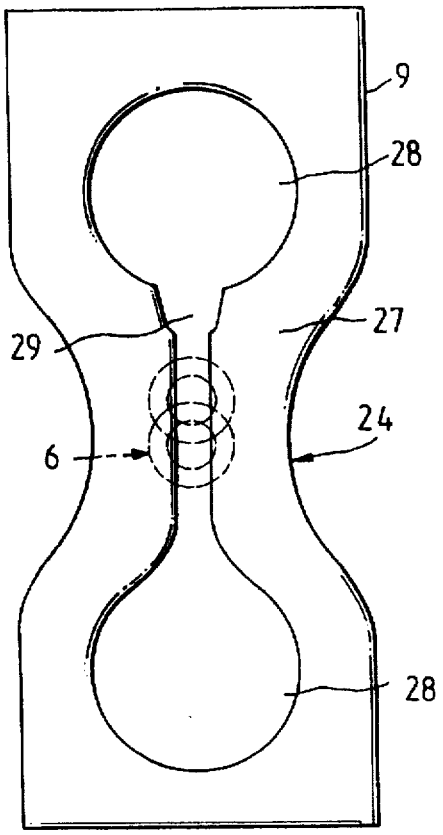
FIG.7
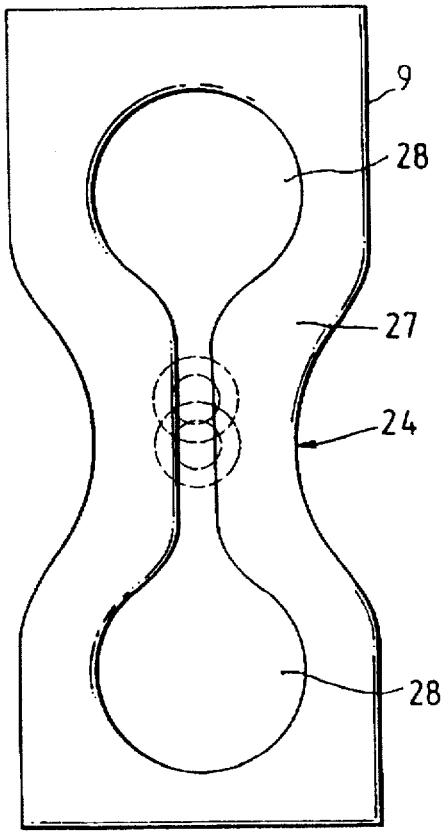

INSULATION DISPLACEMENT CONTACT ELEMENT

FIELD OF THE INVENTION

The present invention relates to an insulation displacement contact element of a blade-type, resilient contact material particularly with a contact slot provided with an insertion opening.

BACKGROUND OF THE INVENTION

An insulation displacement contact element of the type referred to hereinbefore is known in the art from DE 31 16 731 C2. The contact element comprises a plane sheet-metal cut of a blade-type, resilient contact material with parallel outer edges, a punched-out window-type portion with a closed outside border changing over into the parallel outer edges, and a contact slot extending from the punched-out window-type portion and provided with an insertion opening and having inner cutting edges directed towards each other and attached at the inner sides of contact legs formed by a sickle-shaped cut-free portion surrounding the latter. The closed outer border surrounding the punched-out window-type portion is bent off about a bending line extending above the insertion opening transversely to the axis direction of the contact slot by 180° to the rear side of the insulation displacement contact element. The border rests planely at the fork legs receiving the sickle-shaped cut-free portion around the contact legs. Due to this design, the prior art insulation displacement contact element is intended to comprise contact legs that yield in several degrees of freedom to the movement or contact in a tolerance-compensating and clamping manner the metal conductors of the line wires to be clamped. Bending center areas are formed at the end of the clamping contact legs directed towards the insertion opening. At the opposed end of the fork legs, about the bending center zones, a spring-elastic pivoting being intended.

Disadvantageous, herein, in spite of the bending center zones, is the relatively large rigidity of the insulations displacement contact element. This is due to the double walls formed by the closed outer border bent by 180° about the rear side of the insulation displacement contact element and surrounding the punched-out window-type portion.

SUMMARY AND OBJECTS OF THE INVENTION

It is therefore the object of the invention to further improve the spring properties of the insulation displacement contact element of the type referred to hereinbefore.

According to the invention, an insulation displacement contact element of a blade-type is provided, formed of resilient contact material. The contact element has a contact slot provided with an insertion opening. The outer edges generally parallel to the contact slot are provided in the area of the wire contact zone of the contact slot with cutouts. With this construction, better spring properties with the same constructional size of the insulation displacement contact element according to the invention relative to the prior art insulation displacement contact element are achieved. Further, it is possible, with the same spring properties, to reduce the constructional size of the insulation displacement contact element according to the invention relative to the prior art insulation displacement contact element, or to use a spring material as contact material having poorer spring properties compared to the standard material. By the arrangement of cutouts according to the invention, the cross-sections of the lateral contact legs become smaller in the area of the wire contact zone. Smaller inertia and resistance moments and a higher deformability is obtained. Therefore, the contact properties are improved, due to the torsion of the contact legs and their matching to different wire diameters being improved. In total, a clear improvement of the spring properties can be achieved.

The length of the cutouts preferably approximately corresponds to the length of the wire contact zone of the contact slot. The width (B) of the cutouts preferably approximately corresponds to the width (b) of the contact material of the contact legs existing between the cut-outs and the contact slot.

An inner end of the contact slot, opposed to the insertion opening is preferably provided with triangular, lateral cut-free portions increasing the width of the base relative to the width of the contact slot, and with a semicircle terminating the inner end. With these features, a substantial improvement of the spring properties is obtained.

The preferred design of an insulation displacement contact element has a U-shaped slot crossing its base slot, the outer edges of which are parallel to each other. This gives a substantial improvement of the spring properties with regard to an insulation displacement contact element.

The insertion opening is preferably V-shaped. The free ends of the contact slot legs are preferably connected to each other in the area of the insertion opening by means of a bracket-type web. When such an insulation displacement contact element is inclinedly mounted in the housing of a terminal block, no support forces act on the housing. Simultaneously, an improvement of the bending stresses is obtained by a higher rigidity of the insulation displacement contact element in the area of the V-shaped insertion opening.

Further aspects of the invention include providing curved cutouts as a polygon, parabola or the like, and providing the insertion opening of the contact slot as a full circle.

In the following, the invention will be described in more detail, with reference to seven different disclosed embodiments of insulation displacement contact elements.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 5 is a front view of a fifth embodiment;

FIG. 6 is a front view of a sixth embodiment;

FIG. 7 is a front view of a seventh embodiment slightly modified relative to the sixth embodiment.

DETAILED DESCRIPTION OF THE PREFERRED EMBODIMENTS

Figure 1:
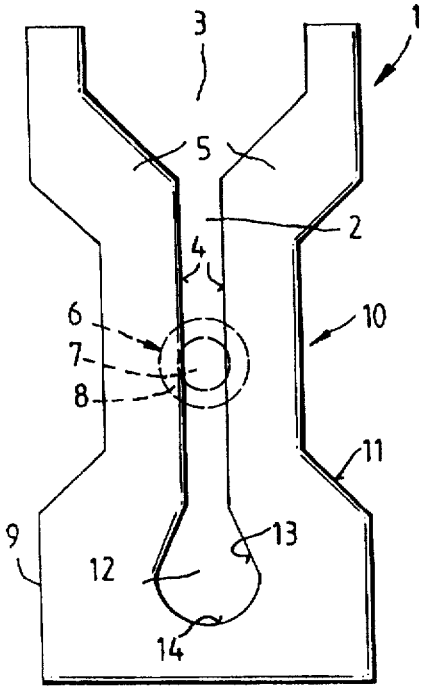
FIG. 1 is a front view of a first embodiment according to the invention.

The insulation displacement contact element 1 according to the first embodiment shown in FIG. 1 is of a blade-type, resilient contact material and has a contact slot 2 provided with a V-shaped insertion opening 3. The contact slot 2 has two opposed, parallel cutting edges on the inner sides of the contact legs 5 limiting the contact slot 2. A not stripped line wire 6 is inserted into the contact slot 2. The insulation 8 of the wire 6 is cut by the cutting edges 4 and the metal core 7 of which is electrically contacted by the contact legs 5. It is usual that such an insulation displacement contact element 1 is inserted into a housing of a terminal block of plastic not shown in more detail, the insulation displacement contact element 1 being disposed transversely to the longitudinal axis of the line wire 6 or at an angle thereto, preferably 45°, but other angles also being possible.

The outer edges 9 of the insulation displacement contact element 1 preferably arranged parallel, but also inclined to each other are provided with cutouts 10 in the area of the wire contact zone of the contact slot 2, approximately in the longitudinal center area of the contact slot 2. The length L of the cutouts 10 approximately corresponds to the length 1 of the wire contact zone of the contact slot 2. The width B of the cutouts approximately corresponds to the width b of the contact material of the contact legs 5 existing between the cutouts 10 and the contact slot 2. The cutouts 10 are provided with inclined faces 11 at the end sides.

The inner end 12 of the contact slot 2 opposed to the insertion opening 3 is provided with triangular, lateral cut-free portions 13 increasing the width of the inner end 12 relative to the width of the contact slot 2, and go over into a semi-circle 14 terminating the latter.

By the lateral cutouts 10 generally disposed in the longitudinal center area of the contact slot 2 and by the triangular, cut-free portions 13 and the semi-circle 14 at the inner end 12 of the contact slot 2, an improved spring behavior in the contact area is achieved. When contacting two line wires 8 after each other in a contact slot 2, there are better properties concerning double contacts. The contact properties are in addition improved concerning their spring properties, by that the torsion of the contact legs and their matching to different wire diameters are improved. In total, a clear improvement of the spring properties can be achieved.

Figure 2:
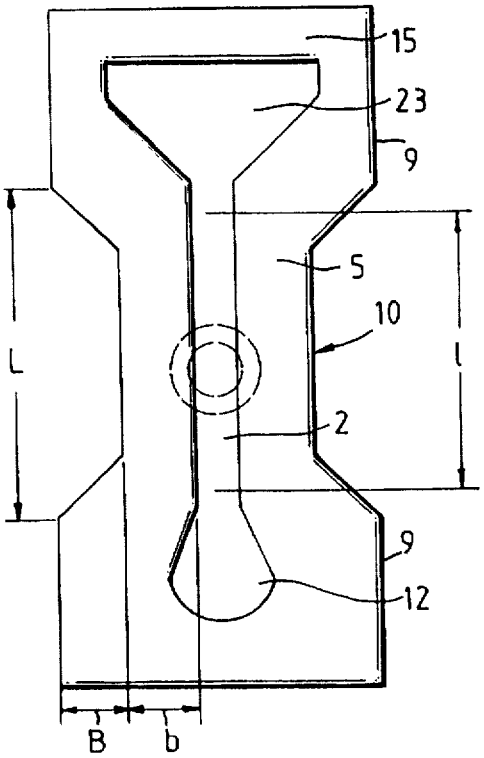
FIG. 2 is a front view of the second embodiment slightly modified relative to the first embodiment.

In the second embodiment shown in FIG. 2, the free upper ends of the contact legs 5 are connected to each other above the V-shaped insertion opening 3 by means of a bracket-type web 15 including a closed V-shaped insertion opening 23. Hereby, the rigidity of the insulation displacement contact element 1 is improved. For an assembly at an angle other than 90° to the longitudinal axis of a line wire 6 in a terminal block, no support forces act on the housing, and a better absorption of bending stresses is obtained.

Figure 3:
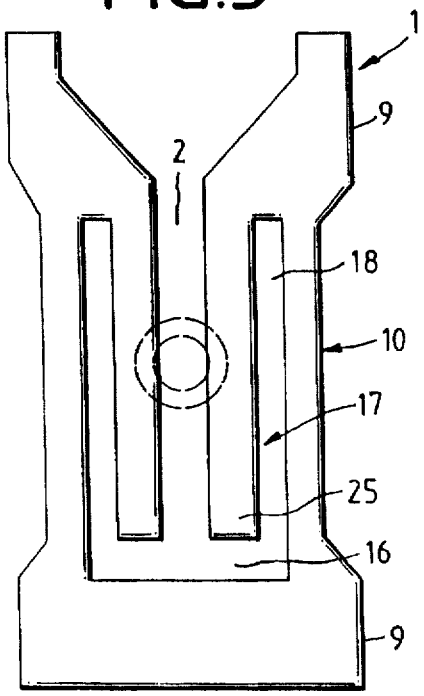
FIG. 3 is a front view of a third embodiment.

In the third embodiment shown in FIG. 3, the base slot 16 of a U-shaped slot 17 is transversely connected to the end of the contact slot 2 opposed to the V-shaped insertion opening 3, and the side slots 18 of the U-shaped slot 17 show towards the insertion opening 3. In this insulation displacement contact element 1, too, the parallel outer edges 9 are provided with cutouts, 10 in the wire contact zone of the contact slot 2, thereby a distinct improvement of the spring properties of the insulation displacement contact element 1 being achieved. A double resilience in the contact area is obtained, the two cutting edges 4 of the contact legs 25 of the contact slot 2 being always parallel, even under load by a line wire 6. Further, better properties concerning double contacts by two line wires 6 inserted one after the other into the contact slot 2 are obtained. Finally, a movement or slipping-out of the line wire 6 from the contact slot 2, e.g. by vibrations, is not possible anymore. The two cutting edges 4 are always parallel, even under load by a line wire 6. Finally, a movement or slipping-out of the line wire 6 from the free outer end of the contact slot 2, which could occur, e.g. by vibrations, is not possible anymore.

Figure 4:
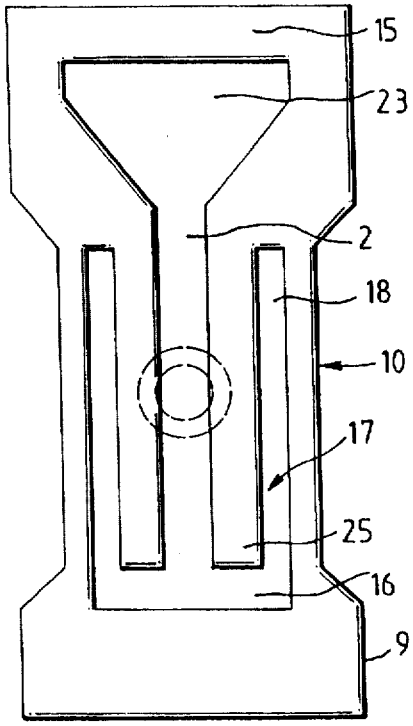
FIG. 4 is a front view of a fourth embodiment slightly modified relative to the third embodiment.

The fourth embodiment shown in FIG. 4 is slightly different from the third embodiment shown in FIG. 3. The V-shaped insertion opening 3 is bridged by bracket-type web 15—similar to the second embodiment shown in FIG. 2. The web connects the free ends of the contact legs 5 in the area of the insertion opening 3 to each other and forms a closed V-shaped insertion opening 23. Hereby, similar properties are obtained as in the subject matter of the second embodiment of FIG. 2.

The fifth embodiment shown in FIG. 5 corresponds in its basic structure to the first embodiment of the insulation displacement contact element shown in FIG. 1. The contact slot 2 is identical with its inner end 12, but the V-shaped insertion opening 3 is rounded-off with radii 19 to the outer, upper end of the contact leg 26. The cutouts 10 on the outer sides of the contact legs 5 are rounded-off with radii 20 instead of the inclined faces 13 of FIG. 1. Further, the corner between the left-hand outer edge 9 and the lower outer edge 22 shown on the left-hand side of FIG. 6 is rounded off with a large radius. All these constructional modifications contribute to improvements of the spring properties of the insulation displacement contact element 1.

In the sixth and seventh embodiments shown in FIGS. 6 and 7, resp., the outer cutouts 24 are shaped as a polygon, a parabola or the like, giving the insulation displacement contact element 1, closed at all outer edges, the shape of a sandglass (hourglass). The contact slot 2 extends between two circularly rounded-off insertion opening 28. In the embodiment of FIG. 6, the insertion opening 28 goes over a wedge-shaped cutting portion 29 into the contact slot 2.

While specific embodiments of the invention have been shown and described in detail to illustrate the application of the principles of the invention, it will be understood that the invention may be embodied otherwise without departing from such principles.

What is claimed:

1. An insulation displacement contact element, comprising:

a blade-type, resilient contact material formed with a contact slot provided with an insertion opening and an inner end, opposite the insertion opening, said contact slot insertion opening and said contact slot inner end having a greater width than a width of said contact slot between said inner end and said insertion opening, said contact slot defining a wire contact zone with parallel edges above said inner end and below said insertion opening, said blade-type resilient contact material having outer edges generally parallel to each other and parallel to said parallel edges of said contact zone, said outer edges defining a first contact material width corresponding to said inner end and a second contact material width corresponding to said contact zone and a third contact material width corresponding to said insertion opening, said second contact material width being smaller than said first contact material width and smaller than said third contact material width said second contact material width being formed by providing resilient material cutouts in said resilient material in an area of said contact zone, wherein a length of said cutouts approximately corresponds to a length of said wire contact zone of said contact slot.

2. An insulation displacement contact element according to claim 1, wherein a width of said cutouts approximately corresponds to a width of contact material of the contact legs, each contact leg being provided between a cut-out and said contact slot.

3. An insulation displacement contact element according to claim 1, wherein said inner end of said contact slot, opposed to said insertion opening is provided with triangular, lateral cut-free portions increasing a width of said inner end relative to a width of said contact slot at said contact zone, and with a semi-circle terminating said inner end.

4. An insulation displacement contact element according to claim 1, wherein a U-shaped slot is provided formed with a base slot transversely connected to said inner end of said contact slot, opposed to said insertion opening, and lateral slots of said U-shaped slot extend towards said insertion opening.

5. An insulation displacement contact element according to claim 1, wherein said insertion opening is V-shaped, and free ends of said contact slot legs are connected to each other in an area of said insertion opening by means of a bracket-type web.

6. An insulation displacement contact element according to claim 1, wherein said cutouts are shaped at outer edges as one of a polygon and a parabola.

7. An insulation displacement contact element according to claim 1, wherein:

said first contact width is substantially similar to said third contact material width;

said insertion opening is V-shaped and directly connected to said contact zone.

8. An insulation displacement contact element according to claim 1, wherein:

said cutouts have ends adjacent said inner end, said ends having inclined faces.

9. An insulation displacement contact element, comprising a resilient contact material formed with a first contact leg, a second contact leg and a base portion, connecting said first contact leg and said second contact leg, said first contact leg and said second contact leg cooperating to define a contact slot therebetween, said contact slot having an insertion opening and an opposite inner end, said contact slot having a wire contact zone, said first contact leg and said second contact leg having outer edges parallel to each other and parallel to edges of said contact slot, said outer edges defining a first contact material width corresponding to said inner end and a second contact material width corresponding to said contact zone and a third contact material width corresponding to said insertion opening, said second contact material width being smaller than said first contact material width and smaller than said third contact material width, said second contact material width being formed by providing resilient material cutouts in said resilient material in an area of said contact zone, wherein a length of said cutouts approximately corresponds to a length of said wire contact zone of said contact slot.

10. An insulation displacement contact element according to claim 9, wherein a width of said cutouts approximately corresponds to a width of contact material of said contact legs, each contact leg being provided between a cut-out and said contact slot.

11. An insulation displacement contact element according to claim 9, further comprising a bracket-type web connecting an upper end of said first aid contact leg with an upper end of said second contact leg in an area adjacent said insertion opening.

12. An insulation displacement contact element according to claim 9, wherein said insertion opening is V-shaped.

13. An insulation displacement contact element according to claim 9, wherein said cutouts are shaped at outer edges as one of a polygon and a parabola.

14. An insulation displacement contact element according to claim 9, further comprising a bracket-type web connecting an upper end of said first contact leg with an upper end of said second contact leg in an area adjacent said insertion opening, said insertion opening being partially defined by said web and having a full circle shape.

15. An insulation displacement contact element according to claim 9, wherein:

said first contact width is substantially similar to said third contact material width;

said insertion opening is V-shaped and directly connected to said contact zone.

16. An insulation displacement contact element according to claim 9, wherein: said cutouts have ends adjacent said inner end, said ends having inclined faces.

17. An insulation displacement contact element according to claim 9, wherein:

said edges of said contact slot are parallel to each other and are parallel to said outer edges.

18. An insulation displacement contact element, comprising a resilient contact material formed with a first contact leg, a second contact leg and a base portion, connecting said first contact leg and said second contact leg, said first contact leg and said second contact leg cooperating to define a contact slot therebetween, said contact slot having an insertion opening, said contact slot having a wire contact zone, said first contact leg and said second contact leg having outer edges, said outer edges being provided with cutouts in an area of said contact zone such that said cutouts maintain said outer edges in parallel relation to said contact slot, wherein said contact slot has an inner end, opposed to said insertion opening, said inner end being provided with triangular, lateral cut-free portions increasing a width of said inner end relative to a width of said contact slot at said contact zone.

19. An insulation displacement contact element according to claim 18, wherein said inner end is formed as a semi-circle at a terminating portion.

20. An insulation displacement contact element, comprising a resilient contact material formed with a first contact leg, a second contact leg and a base portion, connecting said first contact leg and said second contact leg, said first contact leg and said second contact leg cooperating to define a contact slot therebetween, said contact slot having an insertion opening, said contact slot having a wire contact zone, said first contact leg and said second contact leg having outer edges generally parallel to said contact slot, said outer edges being provided with cutouts in an area of said contact zone, wherein a U-shaped slot is formed in said resilient contact material with a base slot transversely connected to an inner end of said contact slot, opposed to said insertion opening, and lateral slots of said U-shaped slot extend towards said insertion opening.

* * * * *